United States Patent [19]

Kim

[11] Patent Number: 5,029,865

[45] Date of Patent: Jul. 9, 1991

[54] GOLF CLUB

[75] Inventor: Dong S. T. Kim, Chester, N.J.

[73] Assignee: DSK Diamond, Inc., Flanders, N.J.

[21] Appl. No.: 536,183

[22] Filed: Jun. 11, 1990

Related U.S. Application Data

[62] Division of Ser. No. 480,252, Feb. 15, 1990, Pat. No. 4,951,953.

[51] Int. Cl.[5] ..... A63B 53/10

[52] U.S. Cl. ..... 273/175; 273/167 J

[58] Field of Search ..... 273/80 B, 167 J, 33, 273/80.3, 167 R, 167 A, 167 E, 167 F, 167 H, 167 K, 168, 173, 174, 78, 175, 80 R

[56] References Cited

U.S. PATENT DOCUMENTS

| | | | |
|---|---|---|---|
| Re. 29,285 | 2/1976 | Christini et al. | 428/426 |
| 2,908,502 | 10/1959 | Bradstreet et al. | 273/167 J |
| 3,218,072 | 11/1965 | Burr | 273/78 |
| 4,015,360 | 4/1977 | Herter | 43/18 GF |
| 4,188,032 | 2/1980 | Yanagioka | 273/80 R |
| 4,470,600 | 9/1984 | Parente et al. | 273/80 B |
| 4,545,580 | 10/1985 | Tomita | 273/167 H |
| 4,547,407 | 10/1985 | Spencer, Jr. | 427/367 |
| 4,768,787 | 9/1988 | Shira | 273/175 |
| 4,792,140 | 12/1988 | Yamaguchi et al. | 273/173 |
| 4,809,978 | 3/1989 | Yamaguchi et al. | 273/78 |

FOREIGN PATENT DOCUMENTS

| | | | |
|---|---|---|---|
| 268181 | 7/1965 | Australia | 273/167 J |
| 0026929 | 2/1977 | Japan | 273/167 J |

OTHER PUBLICATIONS

Peters, F. J., "Ceramic Preforms Use in Aluminum Composites", *Light Metal Age*, pp. 5–8.

Wirtner, M. J., *Ceramic Fibers* (Modern Plastics Encyclopedia), pp. 199–201 (1989).

Bachmann and Messler, *Chemical Engineering News*, pp. 24–39 (May 15, 1989).

*Primary Examiner*—George J. Marlo

*Attorney, Agent, or Firm*—Morgan & Finnegan

[57] ABSTRACT

A golf club coated with a high Young's Modulus material or with a composite material having a high Young's Modulus material as a substantial ingredient in the matrix. Diamond is a particularly preferred as a coating or coating component due to its high strength and relatively low density. The coating may be applied, for example, using an electroless "composite diamond coating" technique, to either the head and shaft of the club, the club head only or the shaft only.

8 Claims, 1 Drawing Sheet

GOLF CLUB

This is a divisional of co-pending application Ser. No. 07/480,252 filed Feb. 15, 1990, now U.S. Pat. No. 4,951,953.

BACKGROUND OF THE INVENTION

The invention pertains to golf clubs. More particularly, the invention pertains to golf club constructions having improved directional accuracy and impact performance characteristics.

A golf club generally includes two major parts, i.e., a club head which provides a ball striking face, and a shaft having one end adapted to provide a gripping location and an opposite end attached to the club head.

People have long sought to improve golf club performance to facilitate hitting golf balls longer distances and with greater directional accuracy. Recent improvements in the technology of golf club design and configuration include the use of metals or epoxy reinforced carbon fibers as materials for constructing "wood" heads, and using epoxy-carbon fiber composites as materials for constructing club shafts.

Some recent designs incorporating the above improvements have resulted in clubs capable of hitting a ball longer distances. However, such results are generally viewed as being somewhat inconsistent. Notwithstanding such inconsistency, the achievement of the longer flight distance is generally credited to the use of high rigidity materials in constructing modern golf clubs.

The rigidity of a material is often expressed by its "Young's Modulus" In general, the greater the Young's Modulus of the materials used for constructing golf clubs, the greater will be the distance travelled by the ball (hereinafter referred to as "flying distance"). This results from greater power transfer being achieved from the club to the ball through use of the high rigidity materials.

In contrast, however, many club designers believe that increased flying distance results, not only from high rigidity materials, but from an increased freedom of designing the overall configuration of the club. This increases in club design freedom results, in great part, from the materials employed, particularly epoxy-carbon fiber composites. Since carbon fiber composites possess much higher rigidity and lower density than steel, for example, a club designer has more freedom when using such composite materials to distribute the weight of the club to critical points, such that the club can generate maximum power upon impact with the golf ball.

However, as is well-recognized by golf enthusiasts, the new light-weight, carbon-fiber shafts (including those incorporating expensive and specialized metals such as boron) often exhibit torque or twisting of the club head relative to the shaft on down-swing and particularly at ball contact. Thus, although the carbon-fiber shaft clubs offer some weight and design configuration advantages over steel shaft clubs, the carbon fiber shaft clubs are generally recognized as being somewhat difficult to control. As is well-known, the inability to control the club head leads to poor accuracy and diminished flying distance.

Thus, although there have been some recent improvements in golf club design and technology, the performance of modern golf clubs can still be improved to further increase flying distance and accuracy characteristics.

It is therefor an object of the invention to provide a golf club which is able to achieve increased flight distance performance.

It is a further object of the invention to provide a golf club which provides increased control over the club shaft and head.

It is a further object of the invention to provide a golf club which enables greater ball control and accuracy It is a still further object of the invention to provide a golf club which has both improved ball flying distance and accuracy characteristics.

SUMMARY OF THE INVENTION

These and other objects of the invention are achieved by providing a golf club which is coated with a high Young's Modulus material or with a composite material having a high Young's Modulus material as a substantial ingredient in the matrix. The percent composition in the coating of the high Young's Modulus material should be at least about 10% and preferably greater than about 20%.

The high Young's Modulus material selected should preferably also have a relatively low density to provide light weight characteristics. Diamond is a particularly preferred as a coating or coating component due to its high strength and relatively low density.

The coating may be applied, for example, using an electroless "composite diamond coating" technique, to either only the striking face of the club head or, preferably, to a substantial portion of the shaft below the grip and over the club head continuously over the junction between the shaft and club head. The resultant coating may have a thickness of from about 1 to 10 mils.

BRIEF DESCRIPTION OF THE DRAWINGS

The invention will be described in greater detail below by way of reference to the following drawings, wherein.

DETAILED DESCRIPTION OF THE INVENTION

Figure 1A:
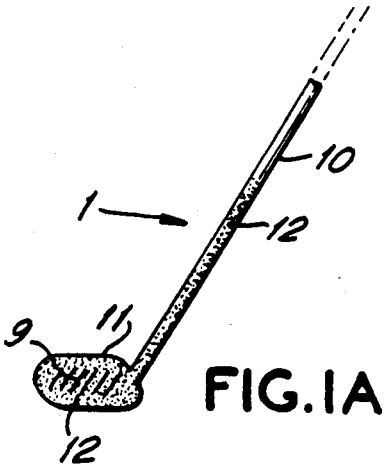
FIGS. 1A and 1B are front and rear elevation views of a golf club according to one embodiment of the invention having coating on the club head and shaft.
Figure 1B:
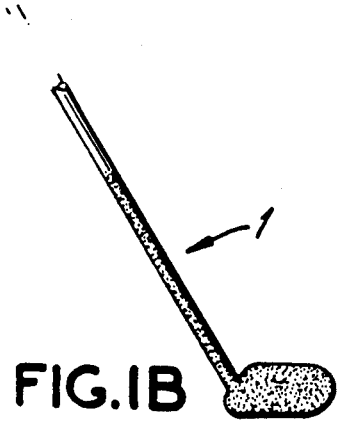

FIGS. 1A and 1B illustrate front and rear views, respectively, of a golf club 1 according to one preferred embodiment of the invention.

FIGS. 1A and 1B illustrate the club 1 including shaft 10 and a club head 11 having a striking face 9. A coating 12 which includes a high Young's Modulus material such as diamond is applied (in a manner such as described below) to the shaft 10. The coating 12 may be applied over: (a) the entire shaft 10 including the portion of the shaft under the grip (not shown); (b) the entire shaft below the grip; or (c) a substantial portion of the shaft above the club head 11. Additionally, in the embodiment of FIGS. 1A and 1B, the coating is applied over the head 11. The coating should preferably be applied to the striking face of the head to increase impact performance and may additionally or alternatively be applied all about the head.

Figure 2:
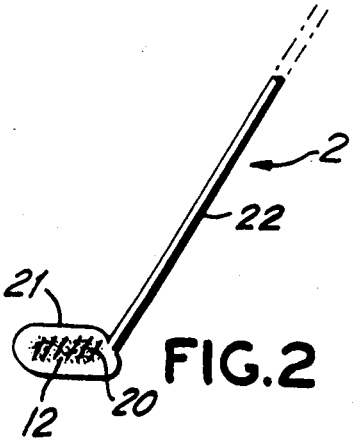
FIG. 2 is a front elevation view of a golf club according to a further embodiment of the invention having coating on the club head.

FIG. 2 thus illustrates a further embodiment where a club 2 is coated, including the striking face 20 of the head 21. In this embodiment, the shaft 22 is not coated.

Figure 3:
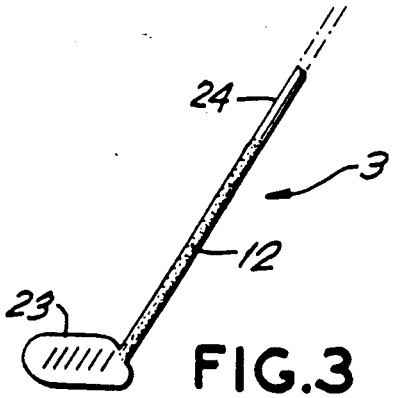
FIG. 3 is a front elevational view of a golf club according to a further embodiment of the invention having coating on the club shaft.

FIG. 3 discloses a further embodiment of the invention wherein the shaft 24 is provided with the coating 12. In this embodiment, the head 23 is not coated.

In order to provide a golf club having longer flying distance and greater directional accuracy characteristics, three requirements should be met.

First, at the impact of the club head against a ball, the power being generated by the club head should be transferred as completely as possible to the ball to result in an increased flying distance. Generally, a greater power transfer can be achieved by constructing the ball-striking face of the club head with a material having a high hardness or a high Young's Modulus. Therefore, steel and carbon fiber composites perform well as materials for constructing club heads.

Second, the restitution time of the club shaft should be as short as possible to achieve accurate timing for releasing power on the down-swing of the club. Generally, the greater the Young's Modulus of the materials used for constructing the shaft, the greater the restitution speed (or the shorter the restitution time) of the shaft will be. In other words, as the Young's Modulus of the shaft increases, the restitution time of the club becomes closer to zero. Since carbon fiber possesses less than one-fourth the density of steel, but approximately same Young's Modulus in magnitude (see Table 1 below), carbon fiber should theoretically provide a better club shaft, having shorter restitution times and lower material weight as compared with conventional steel shafts.

Third, the torque (torsion) of the club shaft should be as low as possible to result in greater directional accuracy upon impact between the club head and the ball. This is a serious problem in the design of golf clubs Particularly, the thinner end of shaft which is attached to the club head is prone to torsion by the relatively heavy club head on down swing and particularly at impact with the ball. As discussed above, an unfortunate drawback of recent carbon shafts is that they often create worse torque problems than conventional steel shafts.

The present invention addresses all of these three requirements According to the present invention, these requirements are met by coating a golf club (including the head and a substantial portion of the shaft) with either materials having a high Young's Modulus or with high Young's Modulus materials in a composite form with other materials as matrices. The coating of the club face with the high Young's Modulus materials or composites thereof results in improved rebound (impact) characteristics. Moreover, in preferred embodiments where both the club head and a substantial portion of the shaft are coated, the present invention also provides for dramatic improvements in the torque resistance properties of the thinner part of shaft end which is attached to the club head.

The improvement in torque resistance characteristics derives from the fact that, since the shafts are generally made of hollow tubing, the walls of the shaft are thin relative to the thick club head Therefore, the ratio of the thickness of the rigid coating layer to the thickness of shaft wall is far higher than that between the coating layer and the club face The difference in these ratios should generally lead to a far greater effectiveness of the rigid coating on the shaft than on the club head in terms of increasing torque resistance of shaft, particularly at the thinner end of shaft which is most prone to torsion by the heavy club head on downswing and impact.

Golf clubs useful for the present invention (and for being coated by materials disclosed herein according to the invention) can be made from a wide variety of materials, including woods, ceramics, metals, fiber reinforced composites (carbon, glass, etc.) and virtually any other type of golf club material. While all these club constructions are useful in accordance with the invention, presently preferred for the invention are those clubs having shafts which are made of (a) metals or metal alloys such as steel and copper-berillium alloys, and (b) plastics carbon fiber composites such as epoxy-carbon fiber composites The preferred areas to be coated by materials of this invention include the surfaces of the club heads of the "woods" and irons which strike the ball (e.g. 9, FIG. 1A and 20, FIG. 2), and the substantial portion of the shaft (e.g. 10, FIGS. 1A and 1B and 24, FIG. 3) below the upper surface of the shaft which is generally covered by a grip. For example, it may be desirable to coat at least about the lower ⅓ (one-third) of the shaft beginning with the base of the shaft (i.e. the shaft portion in contact with and proximal to the head) and extending upward along the shaft length. It may also be preferred to apply a continuous coating to the head, the junction between the head and the shaft, and the shaft portion proximal to the head, such that a continuous coating covers these areas generally.

It may be further generally preferred in practice to coat the entire surface of club with the coating, particularly when the clubs are made of plastic carbon fiber composites. These types of clubs are generally weak against wear, and their soft surfaces are readily damaged and marred during golf play or through contact with objects which are harder than the plastic matrices. Thus, coating of these surfaces will increase the wear resistance of the club as well.

Useful materials for coating both heads and shafts of golf clubs according to the present invention are those materials which possess a high Young's Modulus. However, when considering the benefits of materials having high rigidity or high Young's Modulus for use according to the invention, the density of the material should also be considered. Such a relationship is expressed by Y/D in Table 1. For example, there is only a small difference in Young's Modulus between steel and carbon fiber as shown in Table 1. However, since it possesses a lower density than does steel, carbon fiber provides a much higher rigidity than does steel on an equivalent weight basis. According to Table 1, carbon fiber is more rigid than steel by 4.5 times.

TABLE 1

PROPERTIES OF RELATED MATERIALS

| Materials | Properties: Density[a] ($g/cm^3$) (D) | Hardness[b] (MOHS) | Young's Modulus (Y) $\times 10^6$ (Psi) | $Y/D \times 10^6$ |
|---|---|---|---|---|
| Diamond | 3.51 | 43–70 | 130–170[b] | 37–48 |
| Silicone Carbide (SiC) | 2.56–3.21 | 14 | 30–100[c][d] | 12–31 |

TABLE 1-continued

PROPERTIES OF RELATED MATERIALS

| Materials | Density[a] (g/cm³) (D) | Hardness[b] (MOHS) | Young's Modulus (Y) × 10⁶ (Psi) | Y/D × 10⁶ |
|---|---|---|---|---|
| Boron | 2.45 | — | 58[c] | 24 |
| Corundum ($Al_2O_3$) | 3.97 | 9 | 76[a] | 19 |
| Carbon Fiber | 1.80 | — | 33[d] | 18 |
| Silicone Nitride ($SiN_4$) | 3.44 | — | 55[a] | 16 |
| Tungsten Carbide (WC) | 15.63 | 9–10 | — | — |
| Iron | 7.86 | — | 28[a] | 4 |
| Silicone | 2.33 | — | 26[a] | 11 |

[a]Density at room temperature, from Handbook of Chemistry and Physics, CRC Press, 58th ed.
[b]R. M. Chrenko and H. M. Strong, General Electric's Technical Information Series, No. 75 CRD089, Oct., 1975
[c]M. J. Wirtner, "Ceramic Fibers" Modern Plastics Encyclopedia, 1989; page 200
[d]F. J. Peters, "Ceramic Preforms Use in Aluminum Composites", Light Metal Age, Aug. 1986; page 5

As also shown in Table 1, the Young's Modulus of ceramics are generally higher than those of metals or metal alloys. On the other hand, metals ordinarily possess a higher density than do ceramics Therefore, ceramics will likely be more highly preferred materials for the invention than are metals.

To be effective as a coating material in a thin layer form, it may be preferable to use materials with Young's Modulus of 50 million pounds per square inch (psi) or higher. Such materials as silicone nitride, corundum (alumina oxide), silicone carbide and diamond, for example, are useful for the invention.

Among these potential materials, diamonds are the hardest material presently known to man and possesses the highest Young's Modulus. Therefore, diamonds are most preferred materials for coatings in accordance with this invention. Since diamonds also possess low specific gravity as compared with metals such as steel, even a one mil thick diamond coating provides a rigidity roughly similar to that of 12 mil steel.

Although it would be ideal to provide a coating of pure diamond on a golf club in accordance with the invention to increase rigidity to a maximum level, the technology for providing diamond coatings in general has long been difficult for both economic as well as technical reasons. Moreover, because of the superior physical and chemical properties which make diamond materials preferred for the present invention, diamonds are also difficult materials to apply on a substrate in the form of coating by either physical or chemical process. For example, processes recently reviewed in *Chemical and Engineering News,* May 15, 1989, pages 24–39 (Bachmann and Messler) for providing an ultra-thin film coating (on the order of 0.1 micron) of pure diamond are so costly and difficult to build up to an effective film thickness that resulting products may become commercially non-competitive (although a golf club coated in accordance with such technology would be within the scope of the present invention).

Another difficulty of using pure diamond is the cost of the material itself Although synthetic diamonds are reasonably priced as compared to natural diamonds, and are very useful for this invention, they are still far more expensive than other lower priced ceramics and metals If it is necessary or desirable to save on the cost of coating material, the diamond component could, of course, be replaced by other desirable high Young's Modulus materials disclosed in accordance with the invention.

In order to make preferred embodiments of the invention economically as well as technically feasible, it has been found that high Young's Modulus coating materials such as diamond can be conveniently applied in the form of a composite with other materials such as nickel as matrices. One such process is called electroless "composite diamond coating" technique. Such techniques are now well known to those skilled in the art of electroless metal plating. Examples of presently known "electroless" composite diamond coating techniques can be found in U.S. Pat. No. 4,547,407 and Re. No. 29,285, which are incorporated herein by reference.

In carrying out a composite coating technique used to create golf clubs in accordance with the present invention, the coating materials are dispersed uniformly into an electroless metal plating bath. Plating of the golf club is carried out for a certain period until a targeted thickness of coating layer is achieved A useful percent compositional range for the coating materials in accordance with the invention is from about 10% by volume in the concentration after coating, with a preferred and significantly effective range starting from about 20% of the coated layer and ranging upward. A useful thickness for the coating layer in accordance with the present invention ranges from about 0.5 mil to 5 mil or from approximately 10 microns to 100 microns, and is preferably from about 0.8 mil to about 3 mil or from approximately 20 microns to about 75 microns in thickness. A useful range for the particle size of the coating materials is from about 0.1 micron to about 50 microns with a preferred range being from about 1 micron to about 10 microns.

TEST APPARATUS

Figure 4:
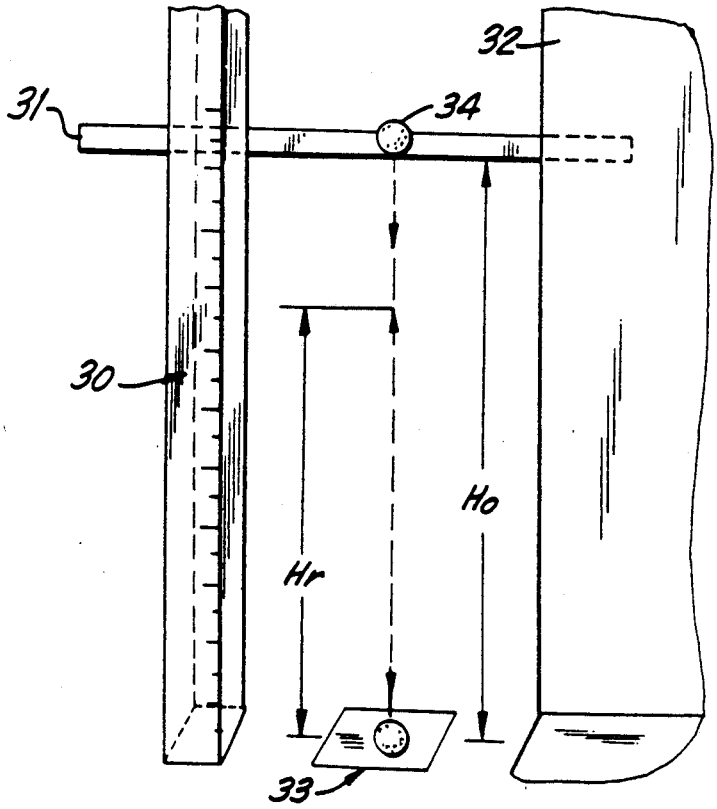
FIG. 4 is an illustration of a testing apparatus designed to demonstrate the effect on golf ball rebound of the coating techniques disclosed herein.

FIG. 4 illustrates an apparatus used to test and demonstrate a concept of this invention. The apparatus of FIG. 4 was designed simply to carry out testing, to assist in the understanding of the impact and rebound principles involved in the invention, and to generate reasonably accurate data.

The test apparatus of FIG. 4 includes a level bar 30 graduated in centimeters, and erected vertically on a ceramic tiled floor. The level bar 30 is secured (e.g. by tying) to a horizontal bar 31. One end of the horizontal bar 31 is fixed on a wall 32 which shares the same floor with the bottom of level bar. A steel sample plate 33, which may be coated or uncoated is fixed on the ceramic floor using adhesive tape (with the coated side facing face up if the plate is coated).

A golf ball 34 trade name Ultra® by Wilson Sporting Goods Co., River Grove, Ill., was dropped so that it falls by its own weight to hit the center of the plate 33. The bottom of the ball was lined up to the bottom line of horizontal bar 31 before the drop. The distance of fall (Ho) was measured to be 104.83 centimeters. The ball 34 rebounds upward after hitting the center of the plate 33. The maximum height of rebound (Hr) is also measured.

The following test is provided to illustrate the concept of the present invention.

TEST

An electroless nickel bath of Enplate 415 (product of Enthone, Inc., New Haven, Connecticut) was prepared as specified by the manufacturer. To this bath were dispersed 28 grams per liter of DuPont polycrystalline diamond with particle size ranging from 1 micron to 6 micron. Using low carbon steel plates measuring $4\times3\times\frac{1}{8}$ inches as substrates, electroless plating was carried out (See U.S. Pat. No. 4,547,407, Example 1) until coating layers with 1 mil and 2 mil thickness were obtained, respectively. An overall concentration of diamond in the composite coating layer was found to be 35% by volume.

Using the apparatus shown in FIG. 4, testing was carried out on steel plates on which the 1 mil and 2 mil diamond composite coatings were applied as above. Rebound from an uncoated steel plate was also measured. The entire test was video-taped using a camcorder. An accurate rebound distance Hr was measured by playing back the tape. Table 2 shows the testing results.

TABLE 2

| Sample # | Steel Plate Coating Thickness | Average Height of Rebound (cm) | Increase of Rebound (%) |
|---|---|---|---|
| 1 | 0 | 70.82 | 0 |
| 2 | 1 mil | 74.37 | 5 |
| 3 | 2 mil | 75.19 | 6 |

The test results recorded in Table 2 demonstrate that diamond can be coated on steel in the form of a composite with nickel as a matrix, and that steel plates thus coated exhibit golf ball rebound characteristics according to the invention improved by over 5% versus an uncoated plate. Since the error range observed was +/−0.5 cm, the improvement is real and significant.

As to the other two requirements discussed above for achieving a long flying distance with an accurate direction, i.e., the restitution speed and the torque resistance of the club shaft, these factors are also improved proportional to the Young's Modulus of the coating materials used. Thus, the results of the above test support the discovery herein that restitution speed and torque resistance properties can be also improved by, e.g. the electroless composite diamond coating process practiced in the test.

Moreover, the improvement in restitution speed and torque resistance will be significant in preferred embodiments where the coating is applied over both the shaft and club head. The effect will be even more significant in embodiments in which the club shaft is hollow. For example, a 1 mil coating of diamond on a club head will increase head rigidity up to a degree equivalent to that of approximately 12 mil steel ($12\times10^{-3}$ inch) as estimated based on the Y/D ratio of Table 1. Since the impact front face of a steel ("wood") club head may be, for example, approximately $\frac{1}{8}$ inch thick, the improvement in head rigidity is about 9.6% over that of a steel club head which is not coated by diamond. However, because the wall thickness of an, e.g. steel shaft is thinner than the front impact face of the club head by approximately one-third, the same 1 mil coating of diamond on a steel shaft will result in an improvement of rigidity of over 3 times that which was obtained for the coated club head.

Of course, the present invention can be varied in many ways. In particular, a wide variety of high Young's Modulus materials and matrices thereof can be applied by a variety of techniques and thicknesses onto the head (and particularly the striking surface of the head) and the shaft of golf clubs in accordance with the invention. The coating itself may be applied in variety of different areas on the club, including the head and shaft, the striking face of the head only or the shaft only. Such variations are not to be regarded as a departure from the spirit and the scope of the invention. Rather, the invention should only be interpreted in accordance with the claims which follow.

I claim:

1. A golf club comprising a head and a shaft, the shaft being attached to the head, and the head having a ball striking surface where at least a central portion of the ball striking surface if covered with a coating having a thickness in the range of 10 to 100 microns and comprising materials characterized by having a Young's Modulus of 50 million psi or higher and a particle size range from 0.1 to 50 microns, said coating improving rebound and power transfer characteristics of said ball striking surface.

2. A golf club as defined in claim 1, wherein the coating materials comprises diamond.

3. A golf club as defined in claim 2, wherein the coating is in the form of a composite comprising a diamond component and metals or metal alloys as matrices.

4. A golf club as defined in claim 3, wherein the metal or metal alloy is nickel or nickel phosphorus.

5. A golf club as defined in claim 3, wherein the coating has been applied on the club by an electroless composite coating process.

6. A golf club as defined in claim 3, wherein the thickness of the composite coating is about 1 to 2 mils.

7. A golf club as defined in claim 3, wherein the average particle size of the diamond component is about 1 to 6 microns in diameter.

8. A golf club as defined in claim 1, wherein said portion of the ball striking surface is comprised of a material selected from the group consisting of steel, copper-berillium alloy, and plastic carbon fiber composites.

* * * * *

UNITED STATES PATENT AND TRADEMARK OFFICE

CERTIFICATE OF CORRECTION

PATENT NO. : 5,029,865

DATED : July 9, 1991

INVENTOR(S) : Doug S. T. Kim

It is certified that error appears in the above-identified patent and that said Letters Patent is hereby corrected as shown below:

In Column 8, line 29, in Claim 1, delete "if" and insert --is-- therefor.

Signed and Sealed this

Twentieth Day of October, 1992

*Attest:*

DOUGLAS B. COMER

*Attesting Officer*

*Acting Commissioner of Patents and Trademarks*